US011716573B2

(12) United States Patent
Chen

(10) Patent No.: US 11,716,573 B2
(45) Date of Patent: Aug. 1, 2023

(54) KINETIC ENERGY EARPHONE SPEAKER

(71) Applicant: Wenzhong Chen, Dongguan (CN)

(72) Inventor: Wenzhong Chen, Dongguan (CN)

( * ) Notice: Subject to any disclaimer, the term of this patent is extended or adjusted under 35 U.S.C. 154(b) by 0 days.

(21) Appl. No.: 17/579,545

(22) Filed: Jan. 19, 2022

(65) Prior Publication Data

US 2022/0240019 A1 Jul. 28, 2022

(30) Foreign Application Priority Data

Jan. 22, 2021 (CN) ..... 202120174514.4

(51) Int. Cl.
*H04R 9/02* (2006.01)
*H04R 1/04* (2006.01)
*H04R 1/10* (2006.01)

(52) U.S. Cl.
CPC ..... *H04R 9/025* (2013.01); *H04R 1/04* (2013.01); *H04R 1/1025* (2013.01)

(58) Field of Classification Search
CPC ..... H04R 9/025; H04R 1/04; H04R 1/1025; H04R 9/06; H04R 1/1075; H04R 9/04
See application file for complete search history.

(56) References Cited

U.S. PATENT DOCUMENTS 10,785,571 B2 * 9/2020 Chen ..... H01L 23/467

FOREIGN PATENT DOCUMENTS

| | | | | |
|---|---|---|---|---|
| CN | 209046839 U | * | 6/2019 | |
| CN | 214070151 U | * | 8/2021 | ..... H04R 1/04 |
| CN | 216057460 U | * | 3/2022 | ..... H04R 1/10 |
| CN | 218041710 U | * | 12/2022 | ..... H04R 1/10 |

* cited by examiner

*Primary Examiner* — Angelica M Mckinney
(74) *Attorney, Agent, or Firm* — Daniel M. Cohn; Howard M. Cohn

(57) ABSTRACT

The present invention discloses a novel kinetic energy earphone speaker, comprising a speaker, a battery, and a PCBA circuit main board. A through-hole is provided in the middle of one side face of the speaker, the battery extends into the through-hole for mounting and arranging, the PCBA circuit main board is sleeve jointed on the extending end of the battery, and a second washer can form one T-type magnetizer with a magnetizer metal casing of the battery. The present invention incorporates part of the volume of the battery into the speaker as a magnetizer, which can reduce the combined use space, make the volume of the product small, and shorten the overall design time.

2 Claims, 1 Drawing Sheet

KINETIC ENERGY EARPHONE SPEAKER

TECHNICAL FIELD

The present invention relates to the technical field of earphones, and particularly to a novel kinetic energy earphone speaker.

BACKGROUND ART

With regard to the currently available audio wearing products on the market, such as earphones, the most difficult to achieve is to make the volume smaller and thinner. The three main components that currently occupy most of the space in the earphones are a speaker, a battery, and a PCBA circuit board. With the rapid development of modern market product technology, all digital products begin the trend of more business portability, which in the case of meeting the condition of no function reduction is how to make the product shape as small as possible, so as to be lighter and more portable;

The design process of an earphone is very tedious (at least 1 month, and up to 3 months). The actual design process of an earphone is taken as an example as follows:

A, design three major components, request samples, and assemble for 20 days: speaker design→battery→circuit design→antenna design→layout→component sample requesting→assembling→debugging→design improvement→improved sample requesting→assembling→debugging verification;

B, assemble functional samples and debug for 10 days: function debugging→antenna debugging→sound debugging→debugging improvement→functional test of the final finished product.

SUMMARY OF THE INVENTION

In order to solve the above-mentioned problems, the present invention provides a novel kinetic energy earphone speaker with small volume and shortened overall design time, which is not only one small volume speaker, but also integrates the battery in the finished product earphone and the PCBA circuit together into the earphone, and debugs all the electric appliance functions/performances possessed by all the finished product earphone; the product application end only needs to be installed in the designed housing to quickly become the finished product earphone of its own model, thereby saving the tedious process and time of proofing, debugging and so on at the application end, and quickly reducing the landing time of the finished product earphone design project.

In order to solve the above technical problem, the technical solution provided by the present invention is: a novel kinetic energy earphone speaker, comprising a speaker, a battery, and a PCBA circuit main board, wherein a through-hole is provided in a middle of a side face of the speaker, the battery extends into the through-hole for mounting and arranging, and the PCBA circuit main board is sleeve jointed on an extending end of the battery.

The speaker comprises a cylindrical housing, a second washer is mounted on a bottom surface of the cylindrical housing, a magnet ring is mounted on an inner side face of the cylindrical housing and closely adjacent to the second washer, a first washer is mounted on the inner side face of the cylindrical housing and closely adjacent to the magnet ring, a voice coil is mounted between the inner side face of the first washer and the other end of the battery, and a membrane is mounted on an open end of the cylindrical housing.

A copper ring is mounted on the open end edge of the cylindrical housing and pressed on the membrane.

the battery comprises a magnetizer metal housing, and the magnetizer metal housing encloses therein an electric core.

The second washer and a magnetizer metal casing form one T-type magnetizer.

The advantages of the present invention over the prior art are as follows:

in the use of the present invention, the second washer and the magnetizer metal housing of the battery constitute one T-type magnetizer, and a part of the volume of the battery is integrated into the speaker as the magnetizer, with the main purpose of reducing the combined use space and improving the debugging performance of the noise reduction effect of the product which is more suitable for the market at present.

DETAILED DESCRIPTION OF THE INVENTION

The present invention will be described below in further detail with reference to the accompanying drawings.

Figure 1:
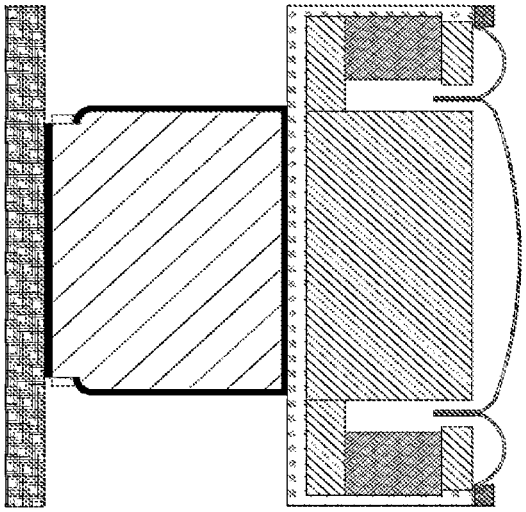
FIG. 1 Prior art
FIG. 1 is a schematic view showing the structure of an existing earphone speaker.
Figure 2:
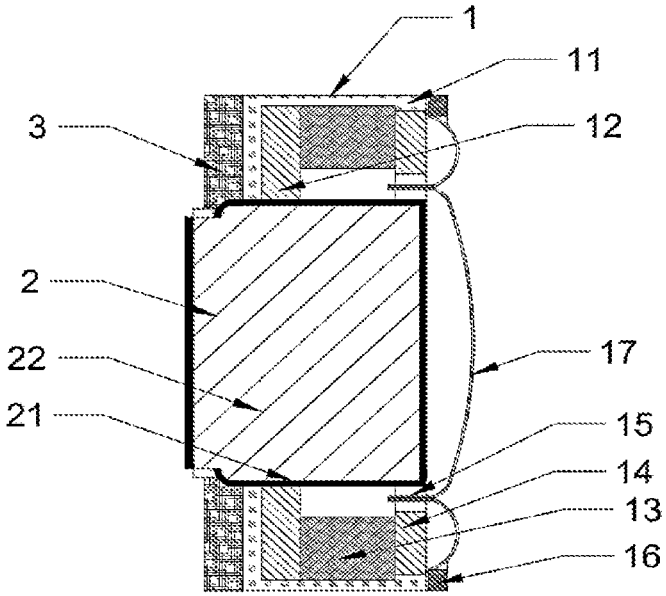
FIG. 2 is a schematic view showing the structure of a novel kinetic energy earphone speaker.

With reference to FIGS. 1 and 2, a novel kinetic energy earphone speaker comprises a speaker 1, a battery 2, and a PCBA circuit main board 3. A through-hole is provided in the middle of one side face of the speaker 1, the battery 2 extends into the through-hole for mounting and arranging, and the PCBA circuit main board 3 is sleeve jointed on an extending end of the battery 2.

The speaker 1 comprises a cylindrical housing 11. A second washer 12 is mounted on the bottom surface of the cylindrical housing 11, a magnet ring 13 is mounted on the inner side face of the cylindrical housing 11 and closely adjacent to the second washer 12, a first washer 14 is mounted on the inner side face of the cylindrical housing 11 and closely adjacent to the magnet ring 13, a voice coil 15 is mounted between the inner side face of the first washer 14 and the other end of the battery 2, and a membrane 17 is mounted on an open end of the cylindrical housing 11.

A copper ring 16 is mounted on the open end edge of the cylindrical housing 11 and pressed on the membrane 17.

The battery 2 comprises a magnetizer metal housing 21 in which an electric core 22 is enclosed.

After passing through the cylindrical housing 11 and the second washer 12, the magnetizer metal casing 21 can form one T-type magnetizer with the second washer 12.

The arrangement of the copper ring can reinforce and support the edge hardness of the membrane so as to facilitate the picking up and laying down of the membrane when assembling; the arrangement of the membrane is directly connected to the voice coil, follows the vibration of the voice coil, and generates a part of an acoustic wave (radiating acoustic wave) by pushing or pulling air; as to the voice coil, an electric current generates a magnetic field through the voice coil to cut magnetic lines so as to vibrate it up and down; as to the arrangement of the first washer and the second washer, the most important function thereof is magnetic conductance function; a magnet ring provides a fixed magnetic field, so that the current flowing through the voice coil and the magnetic field possessed by the magnet cut magnetic lines to generate an acting force; the arrangement of the battery can provide power for the peripheral circuit of the product, and besides the main thing is to use the magnetizer metal housing of the battery as the magnetic conductive component of the magnetic circuit of the speaker, which plays the role of magnetic conduction.

The overall thickness of the novel kinetic energy earphone speaker is 6.86 mm and the existing speaker size is 12.66 mm. The thickness of the novel kinetic energy earphone speaker is reduced by nearly half compared with the existing speaker.

In the use of the present invention, after a voltage/current is input to the voice coil 15 and an electromagnetic force is generated with the magnetic force system, the voice coil 15 is attracted or repelled to generate an up-and-down acting force, thereby realizing controlling to push the vibrating diaphragm/membrane 17 to vibrate and emit sound.

Principle analysis of the magnetic field formation: the T-type magnetizer panel surface is adhered to the N pole of the magnet, the first washer 14 panel surface is adhered to the S pole of the magnet, and a gap with the strongest magnetic field is formed through the magnetic conductance action of the T-type magnetizer and the first washer 14; the middle voice coil 15 is designed to remain in the middle of the gap so that the voice coil 15 is under the strongest stress.

While the present invention and implementation mode thereof have been described above, the description is not to be taken in a limiting sense, and the drawings show only one of the implementation modes of the present invention, and the actual structure is not limited thereto. In summary, if those of ordinary skills in the art are inspired by the teachings of the present invention, structural modes and embodiments similar to the technical solution designed without inventive efforts without departing from the spirit of the present invention shall be within the scope of the present invention.

The invention claimed is:

1. A novel kinetic energy earphone speaker, characterized by comprising a speaker, a battery, and a printed circuit board assembly (PCBA) circuit main board, wherein a through-hole is provided in a middle of a side face of the speaker, the battery extends into the through-hole for mounting and arranging, and the PCBA circuit main board is sleeve jointed on an extending end of the battery;

the speaker comprises a cylindrical housing, a second washer is mounted on a bottom surface of the cylindrical housing, a magnet ring is mounted on an inner side face of the cylindrical housing and closely adjacent to the second washer, a first washer is mounted on the inner side face of the cylindrical housing and closely adjacent to the magnet ring, a voice coil is mounted between an inner side face of the first washer and the other end of the battery, and a membrane is mounted on an open end of the cylindrical housing;

the battery comprises a magnetizer metal housing, and the magnetizer metal housing encloses therein an electric core;

the second washer and a magnetizer metal casing form one T-type magnetizer.

2. The novel kinetic energy earphone speaker according to claim 1, characterized in that a copper ring is mounted on an open end edge of the cylindrical housing and pressed on the membrane.

* * * * *